US010896643B2

(12) United States Patent
Li et al.

(10) Patent No.: US 10,896,643 B2
(45) Date of Patent: Jan. 19, 2021

(54) CURRENT DETECTION METHOD FOR PIXEL CIRCUIT, DISPLAY PANEL AND DISPLAY DEVICE

(71) Applicant: SHANGHAI TIANMA AM-OLED CO., LTD., Shanghai (CN)

(72) Inventors: Yue Li, Shanghai (CN); Gang Liu, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 95 days.

(21) Appl. No.: 15/633,772

(22) Filed: Jun. 27, 2017

(65) Prior Publication Data

US 2018/0254009 A1 Sep. 6, 2018

(30) Foreign Application Priority Data

Mar. 1, 2017 (CN) ..... 2017 1 0117317

(51) Int. Cl.

*G09G 3/3241* (2016.01)
*G09G 3/3233* (2016.01)
*G09G 3/3291* (2016.01)
*G09G 3/3266* (2016.01)

(52) U.S. Cl.

CPC ..... *G09G 3/3241* (2013.01); *G09G 3/3233* (2013.01); *G09G 3/3266* (2013.01); *G09G 3/3291* (2013.01); *G09G 2300/0819* (2013.01); *G09G 2300/0842* (2013.01); *G09G 2310/08* (2013.01); *G09G 2320/0233* (2013.01); *G09G 2320/045* (2013.01)

(58) Field of Classification Search

None

See application file for complete search history.

(56) References Cited

U.S. PATENT DOCUMENTS

| | | | | |
|---|---|---|---|---|
| 9,035,976 | B2 | 5/2015 | Lee et al. | |
| 2013/0083001 | A1 | 4/2013 | Jeong | |
| 2014/0022289 | A1* | 1/2014 | Lee | G09G 3/006 345/691 |
| 2014/0152633 | A1 | 6/2014 | Park et al. | |
| 2014/0168184 | A1* | 6/2014 | Kim | G09G 3/3258 345/209 |

(Continued)

FOREIGN PATENT DOCUMENTS

| | | | |
|---|---|---|---|
| CN | 103077662 | A | 5/2013 |
| CN | 103354603 | A | 6/2014 |

(Continued)

*Primary Examiner* — Ifedayo B Iluyomade

(74) *Attorney, Agent, or Firm* — Kilpatrick Townsend & Stockton, LLP

(57) ABSTRACT

A current detection method for a pixel circuit, a display panel and a display device are provided, for implementing both a compensation for the threshold voltage Vth of the drive transistor and a compensation for the aging of the light emitting element organic light emitting diode (OLED) by controlling to turn on or turn off the first switch transistor and the second switch transistor, and by acquiring the drive current of the drive transistor and the compensation current of the light emitting element, thus the brightness differences among pixels are compensated, thereby avoiding the problem of non-uniform display brightness and poor image uniformity.

18 Claims, 12 Drawing Sheets

(56) References Cited

U.S. PATENT DOCUMENTS

| | | | | |
|---|---|---|---|---|
| 2014/0252988 | A1* | 9/2014 | Azizi | H05B 45/14<br>315/307 |
| 2015/0062192 | A1 | 3/2015 | Kim et al. | |
| 2015/0130785 | A1 | 5/2015 | Shin et al. | |
| 2015/0154913 | A1 | 6/2015 | Kim | |
| 2015/0379937 | A1 | 12/2015 | Kim et al. | |

FOREIGN PATENT DOCUMENTS

| | | | |
|---|---|---|---|
| CN | 104036719 | A | 9/2014 |
| CN | 104424886 | A | 3/2015 |
| CN | 104637443 | A | 5/2015 |
| CN | 104700773 | A | 6/2015 |
| CN | 105321455 | A | 2/2016 |
| EP | 2782090 | A1 | 9/2014 |

* cited by examiner

CURRENT DETECTION METHOD FOR PIXEL CIRCUIT, DISPLAY PANEL AND DISPLAY DEVICE

CROSS REFERENCE TO RELATED APPLICATION

The present application claims the priority to Chinese Patent Application No. 201710117317.7, titled "CURRENT DETECTION METHOD FOR PIXEL CIRCUIT, DISPLAY PANEL AND DISPLAY DEVICE", filed on Mar. 1, 2017 with the State Intellectual Property Office of the PRC, which is incorporated herein by reference in its entirety.

FIELD

The disclosure relates to the technical field of display, and particularly to a current detection method for a pixel circuit, a display panel and a display device.

BACKGROUND

With the continuous development of science and technology, organic light emitting diodes (OLED) have been rapidly developed due to advantages of high brightness, low drive voltage and low power consumption.

Generally, in an organic light emitting diode display device, a pixel circuit is required to drive and control a light emitting element (for example, an OLED). As shown in FIG. 1, a commonly used pixel circuit includes a switch transistor T1, a storage capacitor C1 and a drive transistor T2. The switch transistor T1 provides a data signal Vdata on a data line to a node N1 in response to a scan signal S1 on a scan line, to charge the storage capacitor C1. Then, the drive transistor T2 adjusts a drive current based on a voltage on the storage capacitor C1, thereby controlling the light emitting element to emit light.

However, due to various factors such as process limitations and aging of the drive transistor, a threshold voltage Vth of the drive transistor in the pixel circuit may drift, such that drive currents though different light emitting elements have different magnitudes, which causes a problem of non-uniform display brightness and poor image uniformity on the display device.

SUMMARY

In view of this, a current detection method for a pixel circuit, a display panel and a display device are provided according to the present disclosure, where a drive current of the drive transistor and a compensation current of the light emitting element are acquired for implementing both a compensation for the threshold voltage Vth of the drive transistor and a compensation for the aging of the light emitting element OLED, thereby avoiding the problem of non-uniform display brightness and the poor image uniformity.

In order to achieve the above object, the following technical solutions are provided according to an aspect of the present disclosure.

It is provided a current detection method for a pixel circuit, where the pixel circuit includes:

a light emitting element;

a drive transistor, configured to drive the light emitting element;

a first switch transistor, configured to provide a data signal on a data line connected with the first switch transistor to the gate of the drive transistor in response to a scan signal on a scan line:

a second switch transistor, configured to provide a reference signal on a reference line connected with the second switch transistor to the source of the drive transistor in response to a scan signal on another scan line; and a storage capacitor, configured to store a voltage between the gate and the source of the drive transistor, a charged voltage of the storage capacitor being used as a drive voltage for the drive transistor; and the current detection method includes:

during a first detection period, turning on the first switch transistor and the second switch transistor, to input a first data voltage signal via the data line and input a first reference voltage signal via the reference line;

during a second detection period, turning off the first switch transistor and turning on the second switch transistor, to acquire a first detection current on the reference line;

during a third detection period, turning on the first switch transistor and turning off the second switch transistor, to input a second data voltage signal via the data line; and during a fourth detection period, turning off the first switch transistor and turning on the second switch transistor, to acquire a second detection current on the reference line.

In another aspect, a display panel is further provided according to the present disclosure. The display panel includes:

pixel units arranged in an array, where each of the pixel units includes the above pixel circuit;

multiple data lines, configured to provide data signals to the pixel units;

multiple scan lines, configured to provide scan signals to the pixel units; and multiple reference lines, configured to provide reference signals to the pixel units, where the above current detection method for a pixel circuit is applied to the display panel.

In another aspect, a display device is further provided according to the present disclosure. The display device includes the above display panel.

As compared with the conventional technology, the technical solutions provided according to the present disclosure have the following advantages.

With the current detection method for a pixel circuit, both a compensation for the threshold voltage Vth of the drive transistor and a compensation for the aging of the light emitting element OLED is achieved by controlling to turn on or turn off the first switch transistor and the second switch transistor, and by acquiring the drive current of the drive transistor and the current of the light emitting element, thus the brightness differences among pixels are compensated, thereby avoiding the problem of non-uniform display brightness and poor image uniformity.

BRIEF DESCRIPTION OF THE DRAWINGS

The drawings to be used in the description of the embodiments or the conventional technology will be described briefly as follows, so that the technical solutions according to the embodiments of the present disclosure or according to the conventional technology will become clearer. It is apparent that the drawings in the following description only illustrate some embodiments of the present disclosure. For those skilled in the art, other drawings may be obtained according to these drawings without any creative work.

DETAILED DESCRIPTION OF THE EMBODIMENTS

Hereinafter, the technical solution in various embodiments will be described clearly and completely in conjunction with the drawings in these embodiments. Obviously, the described embodiments are only some embodiments of the present invention, and thus not intended to be limiting. All the other embodiments obtained by those skilled in the art based on the embodiments described in the present disclosure without creative work will fall within the scope of protection of the present disclosure.

The invertors considered that, due to various factors such as process limitations and aging of the drive transistor, a threshold voltage Vth of the drive transistor T2 in the pixel circuit may drift, such that drive currents though different light emitting elements have different magnitudes, which causes a problem of non-uniform display brightness and poor image uniformity on the display device. Therefore, it is provided a current detection method for a pixel circuit, for detecting the drive current of the pixel and compensating the drive current, thereby avoiding the problem of non-uniform display brightness and poor image uniformity.

Figure 2:
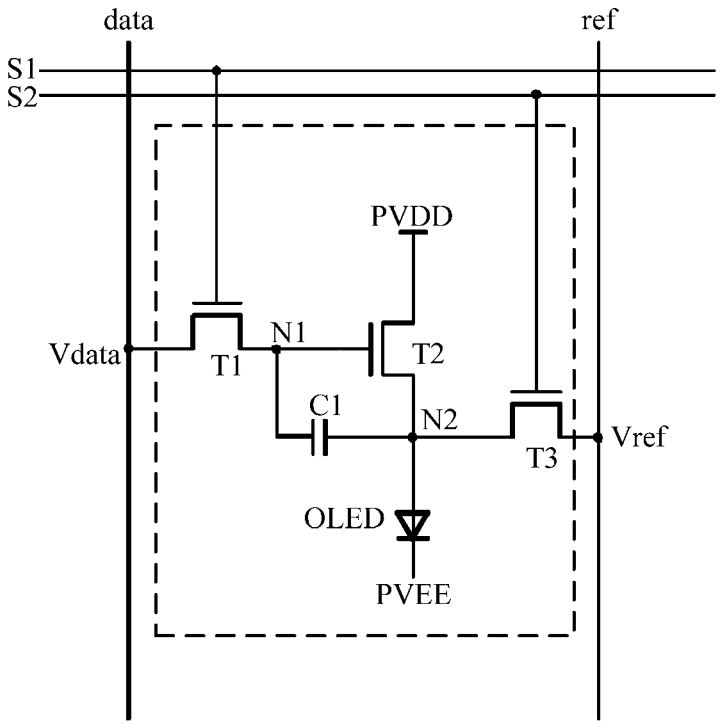
FIG. 2 is a schematic structural diagram of a pixel circuit according to the present disclosure.

Referring to FIG. 2, which is a schematic structural diagram of a pixel circuit on which the current detection method according to this embodiment is based. The pixel circuit includes a light emitting element OLED, a drive transistor T2, a first switch transistor T1, a second switch transistor T3 and a storage capacitor C1.

Connection relationship between various components in the pixel circuit is described as follows.

The drain of the first switch transistor T1 is connected with a corresponding data line data, the gate of the first switch transistor T1 is connected with a corresponding scan line S1, and the source of the first switch transistor T1 is connected with a first terminal of the storage capacitor C1 and a control terminal of the drive transistor T2, where a common connection terminal among the source of the first switch transistor T1, the first terminal of the storage capacitor C and the control terminal of the drive transistor T2 is denoted as a first node N1.

The drain of the drive transistor T2 is fed with a first voltage signal PVDD, a source of the drive transistor T2 is connected with a second terminal of the storage capacitor C1, the anode of the light emitting element OLED and the drain of the second switch transistor T3, where a common connection terminal among the source of the drive transistor T2, the second terminal of the storage capacitor C1, the anode of the light emitting element OLED and the drain of the second switch transistor T3 is denoted as a second node N2. The cathode of the light emitting element OLED is fed with a second voltage signal PVEE.

The gate of the second switch transistor T3 is connected with a corresponding scan line S2, and a source of the second switch transistor T3 is connected with a corresponding reference line ref.

On the basis of the above connection relationship among various components in the pixel circuit, the operation principle of the pixel circuit is as follows.

Figure 1:
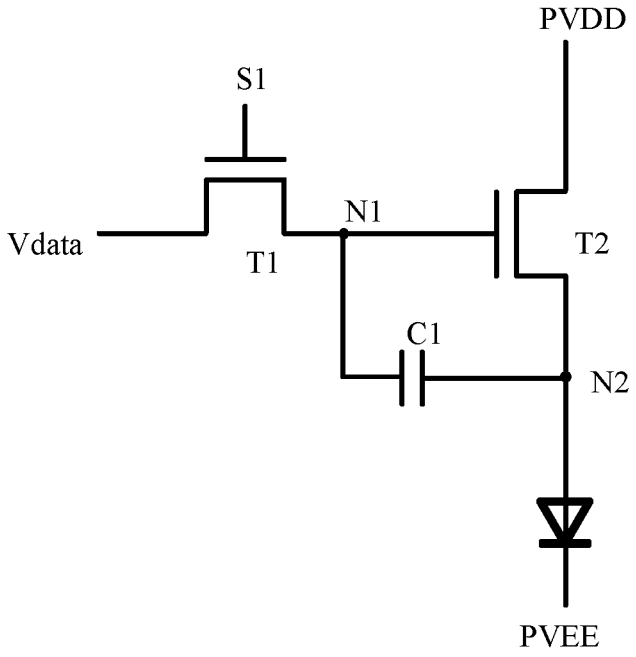
FIG. 1 (PRIOR ART)
FIG. 1 is a circuit schematic diagram of a pixel circuit generally used in the conventional technology.

During a first detection period, the first switch transistor T1 provides a data signal Vdata on the corresponding data line data to the gate of the drive transistor T2. That is, the first node N1 in FIG. 1, in response to a scan signal on the scan line S1 for charging the storage capacitor C1; and the second switch transistor T3 provides a reference signal Vref on the corresponding reference line ref to the source of the drive transistor T2. That is, the second node N2 in FIG. 2, in response to a scan signal on another scan line S2 for resetting the anode of the light emitting element OLED.

The storage capacitor C1 is configured to store a voltage between the gate and the source of the drive transistor T2. That is, a voltage difference between the first node N1 and the second node N2. A charged voltage is used as a drive voltage Vgs for the drive transistor T2. In this case, Vgs=Vdata−Vref. When the charged voltage (Vdata−Vref) of the storage capacitor C1 is higher than a threshold voltage Vth of the drive transistor T2, the drive transistor T2 provides a current directly proportional to the drive voltage Vgs stored by the storage capacitor C1 to the light emitting element OLED via the second node N2, to enable the light emitting element OLED to emit light.

During a second detection period, the second switch transistor T3 is used as an output path between the drive transistor T2 and the reference line ref. At this time, the drive transistor T2 provides a current directly proportional to the drive voltage Vgs stored by the storage capacitor C1 to the second node N2. The current is outputted to the reference line ref via the second switch transistor T3 and acquired by a data driver connected with the reference line ref.

Figure 3:
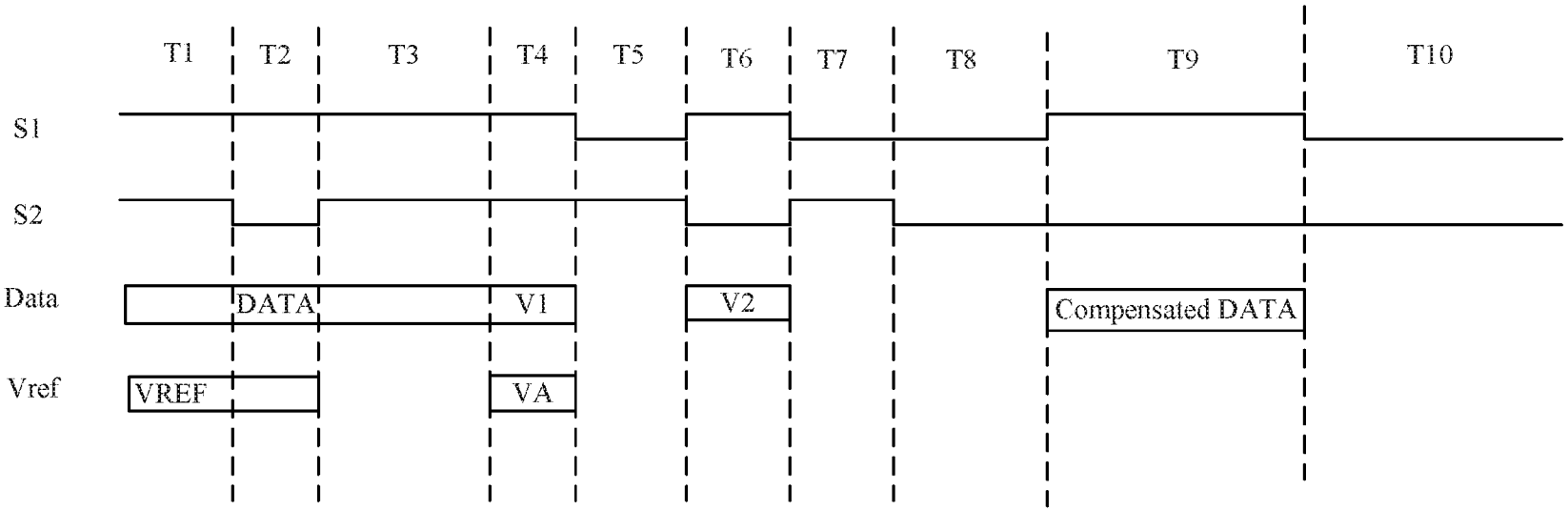
FIG. 3 is a timing diagram of an on-off control timing of a current detection method for a pixel circuit according to the present disclosure.

Specifically, as shown in FIG. 3, which is a timing diagram of an on-off control timing of a current detection method according to this embodiment, the current detection method includes a first detection period T4 and a second detection period T5.

During the first detection period T4, scan signals on the scan line S1 and the scan line S2 are at a high level. The first switch transistor T1 and the second switch transistor T3 are turned on, a first data voltage signal V1 is inputted via the data line, and a first reference voltage signal VA is inputted via the reference line. Directions of the voltage signals are indicated by the arrows in FIG. 4. At this time, a voltage at the first node N1 is V1, a voltage at the second node N2 is VA, the storage capacitor C is charged. When the storage capacitor C1 is charged to the voltage higher than the threshold voltage Vth of the drive transistor T2, the drive transistor T2 is turned on. At this time, the drive transistor T2 provides a current directly proportional to the drive voltage Vgs stored by the storage capacitor C to the light emitting element OLED via the second node N2, to enable the light emitting element OLED to emit light.

Figure 5:
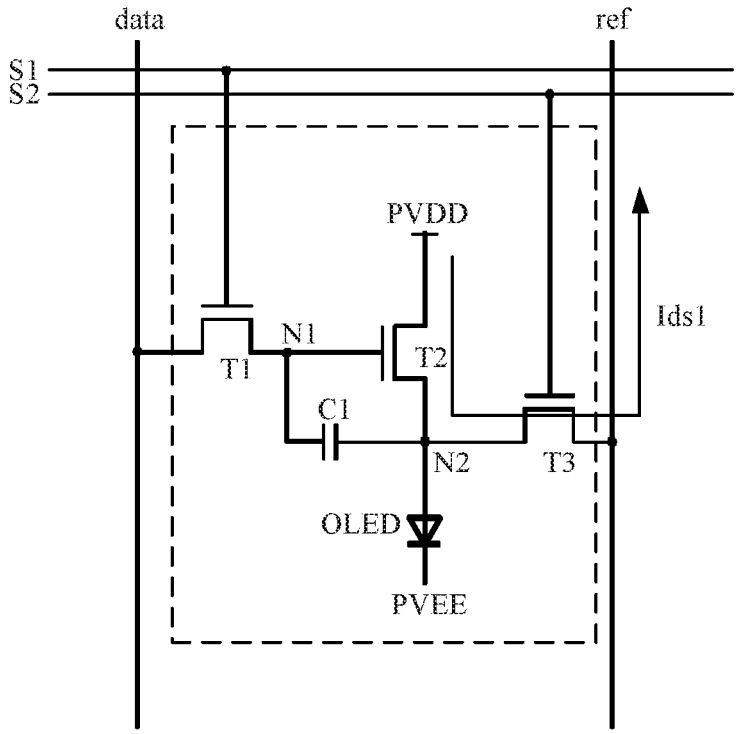
FIG. 5 is a schematic diagram illustrating a current flowing direction in the pixel circuit during another period according to the present disclosure.

During a second detection period T5, the scan signal on the scan line S1 is at a low level, and the scan signal on the scan line S2 is at a high level. At this time, the first switch transistor T1 is turned off, the second switch transistor T3 is turned on. As shown in FIG. 5, a first detection current Ids on the reference line ref is acquired.

It is to be noted that, during the second detection period, the first detection current Ids1 acquired by the data driver is a pixel current characterizing the drive transistor T2 of the pixel. Specifically, with the discharge of the storage capacitor C1, the voltage on the reference line ref increases from the voltage Vref in direct proportion to the pixel current of the drive transistor T2. With the increase of the voltage on the reference line ref, when the drive voltage Vgs stored by the storage capacitor C1 reaches the threshold voltage Vth of the drive transistor T2, the voltage on the reference line ref reaches a saturation voltage, which is a difference between the data voltage Vdata on the data line data and the threshold voltage Vth of the drive transistor T2. At this time, the data driver acquires the pixel current when the voltage on the reference line ref reaches the saturation voltage as the first detection current Ids1.

As can seen, during the second detection period T5, the data driver acquires the current value Vb of the saturation voltage on the reference line ref, where the saturation voltage Vb=Vdata−Vth. Therefore, the threshold voltage Vth of the drive transistor T2 can be calculated after the saturation voltage Vb and the data voltage Vdata is determined. That is, when the saturation voltage Vb on the reference line ref is acquired, the threshold voltage Vth characterizing the drive transistor can be calculated.

In this solution, the data voltage Vdata is a set value V1 inputted from the data line data, the threshold voltage Vth of the drive transistor T2 equals to V1−Vb.

After the threshold voltage Vth of the drive transistor T2 is acquired, a mobility characterizing the drive transistor T2 can be calculated according to a function of a current of the drive transistor. Specifically, the mobility u is calculated according to an equation $I=0.5Cox\times u\times W/L\times(Vgs-Vth)^2$, where I is the drive current of the drive transistor, Cox is a gate oxide capacitance per unit area, u is the mobility, W is a width of the gate of the drive transistor, L is a channel length of the drive transistor, Vgs is a voltage difference between the gate and the source of the drive transistor, and Vth is the threshold voltage of the drive transistor.

On the basis of the equation, during the second detection period T5, the data driver acquires the pixel current Ids1 when the voltage on the reference line ref reaches the saturation voltage, and the threshold voltage Vth of the drive transistor T2. In addition, at this time, the voltage difference between the gate and the source of the drive transistor T2 is Vgs=Vdata−Vref, where Vdata equals to V1, Vref equals to VA. Further, the gate oxide capacitance per unit area Cox, the width of the gate of the drive transistor and the channel length L of the drive transistor are set values. Therefore, the only variable u can be calculated according to the equation, that is, the mobility of the drive transistor can be calculated.

It is to be noted that, according to the above embodiment, the threshold voltage Vth of the drive transistor can be detected. In a case that the display device includes multiple pixels, and each pixel corresponds to one drive transistor, drive currents through the light emitting elements can remain the same when a same voltage is applied on the drive transistors, as long as it is ensured that threshold voltages Vths of all drive transistors of the display device are the same, thereby ensuring that the display device has a uniform display brightness.

Therefore, in this solution, after the threshold voltages Vth of the drive transistors of all pixels are detected, the data driver compensates the threshold voltages Vth, such that compensated threshold voltages of all drive transistors are the same. For example, in a case that a display device includes 100 pixels, each pixel includes one drive transistor, threshold voltages of the 100 drive transistors are acquired using the current detection method for a pixel circuit according to this embodiment, for example, Vth1=1V, Vth2=1.05V, Vth3=1.1V, Vth4=1V, . . . , Vth99=1V. and Vth100=1.1V. The data driver compensates the threshold voltages such that all threshold voltages are set to 1.1v. Therefore, the threshold voltages Vth of all drive transistors of a same display device are the same, thereby avoiding the problem of non-uniform display brightness and poor image uniformity on the display device due to drifts of the threshold voltages Vth of the drive transistors in the pixel circuits caused by factors such as process limitations and aging of the drive transistors.

However, the inventor(s) found that, besides the drift of the threshold voltage Vth of the drive transistor, the light emitting element ages with time passing during use. That is, under a same drive current (a same threshold voltage Vth of the drive transistor), the brightness of the light emitting element varies depending on the degree of aging of the light emitting element OLED.

Based on this, the current detection method for a pixel circuit according to the present disclosure further includes a third detection period T6 and a fourth detection period T7.

Figure 6:
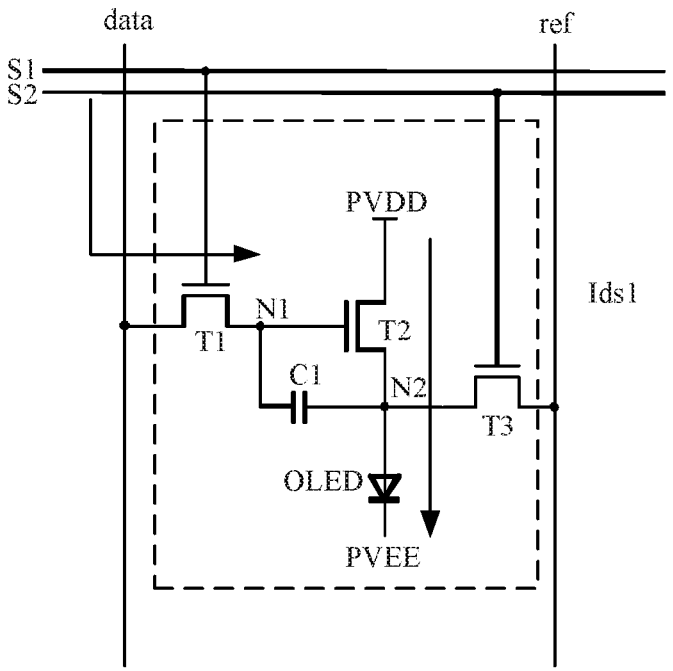
FIG. 6 is a schematic diagram illustrating a current flowing direction in the pixel circuit during another period according to the present disclosure.

During the third detection period T6, the scan signal on the scan line S1 is at a high level, and the scan signal on the scan line S2 is at a low level. At this time, the first switch transistor T1 is turned on, and the second switch transistor T3 is turned off. As shown in FIG. 6, a second data voltage signal V2 is inputted via the data line, and the voltage at the first node N1 is V2. At this time, since the scan signal on the scan line S1 is at a high level, and the first switch transistor T1 is turned on, the first node N1 is at a high level too, such that the drive transistor T2 is turned on, and both the first voltage signal PVDD and the voltage on the storage capacitor C1 are applied on the second node N2, for adjusting the current of the light emitting element OLED to enable the light emitting element OLED to emit light. At this time, the voltage at the second node N2 is the voltage Voled on the light emitting element OLED.

Figure 7:
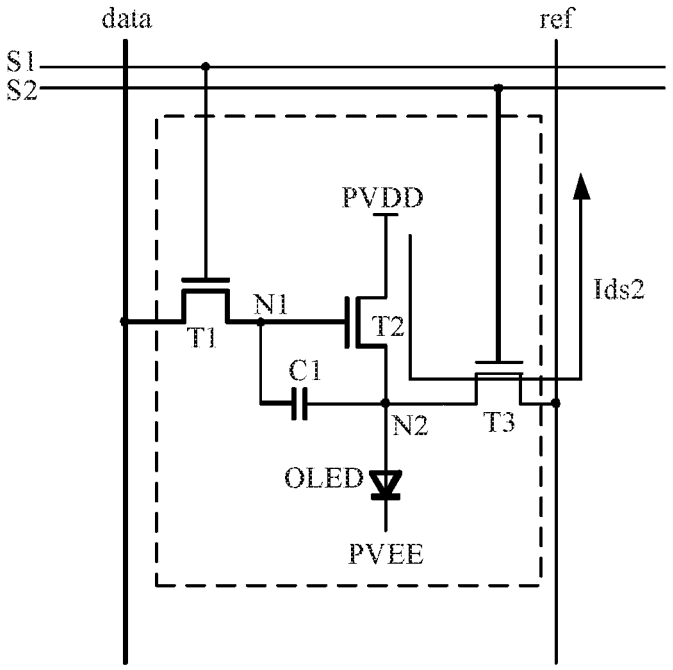
FIG. 7 is a schematic diagram illustrating a current flowing direction in the pixel circuit during another period according to the present disclosure.

During the fourth detection period T7, the scan signal on the scan line S1 is at a low level, and the scan signal on the scan line S2 is at a high level. At this time, the first switch transistor T1 is turned off, and the second switch transistor T3 is turned on. As shown in FIG. 7, a second detection current Ids2 on the reference line ref is acquired.

The inventor(s) found that, in order to ensure the uniform brightness on the display panel, the first detection current Ids1 on the reference line ref acquired during the second detection period T5 needs to be equal to the second detection current Ids2 on the reference line ref acquired during the fourth detection period T7. In addition, according to a feature of the drive transistor that, during operation of the drive transistor, a same detection current Ids can be acquired under a same voltage Vgs between the gate and the source of the drive transistor, in this embodiment, the voltage Vgs of the drive transistor T2 during the first detection period T4 need to be the same as that during the third detection period T6.

Figure 4:
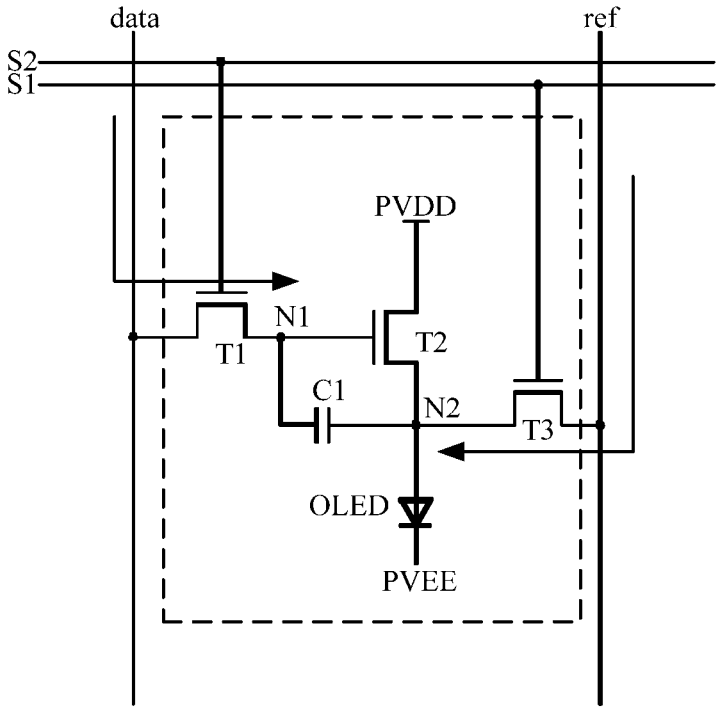
FIG. 4 is a schematic diagram illustrating a current flowing direction in the pixel circuit during a period according to the present disclosure.

As can be seen from FIG. 4 and FIG. 6, during the first detection period T4, the voltage Vgs between the gate and the source of the drive transistor T2 equals to a difference between the voltage at the first node N1 and the voltage at the second node N2. That is, Vgs=V1−VA.

Similarly, during the third detection period T6, the voltage Vgs between the gate and the source of the drive transistor T2 equals to a difference between the voltage at the first node N1 and the voltage at the second node N2, that is, Vgs=V2−Voled.

Then, based on the above embodiments, the drive current of the light emitting element OLED can remain the same during different detection periods as long as it is ensured that V1−VA=V2−Voled, thereby ensuring that the light emitting elements OLEDs have a uniform brightness, thus the problem of non-uniform brightness of the display panel due to aging of the light emitting elements OLEDs can be solved.

Since the first data voltage signal V1 and the first reference voltage signal VA are preset voltage signal values, in this embodiment, the second detection current Ids2 can be made equal to the first detection current Ids1 only by adjusting V2. Therefore, referring to FIG. 3, the current detection method according to this embodiment further includes a compensation calculation period T8.

During the compensation calculation period T8, the scan signal on the scan line S1 and the scan signal on the scan line S2 are at a low level. At this time, the first switch transistor T1 and the second switch transistor T3 are turned off. The control unit calculates a compensation data voltage signal based on the previously detected first detection current Ids1 and the previously detected second detection current Ids2.

Specifically, in the above embodiment, the first detection current Ids1 on the reference line ref may be acquired by the data driver. As described above, the first detection current is the pixel current when the voltage on the reference line ref reaches the saturation voltage. Therefore, in this embodiment, a voltage of the second voltage data signal V2 inputted via the data line data when the second detection current Ids2 equals to the previously acquired first detection current Ids1 is used as the compensated voltage Vdata2.

That is, at this time, the data driver acquires the input voltage Vdata2 during the third detection period T6. By combining the above equation acquired by the invertor, when the second detection current is equal to the first detection current, there is a voltage Voled on the light emitting element OLED satisfying Voled=V2+VA−V1, where VA is the first reference voltage signal, and V1 the first data voltage signal. In this case, V2 equals to the voltage value Vdata2 of the second data voltage signal. Therefore, with the current detection method according to this embodiment, the current voltage Voled on the light emitting element OLED is acquired.

By combining the above description, the drive current Ids2 of the light emitting element OLED during this period is acquired. Therefore, according to a functional relationship between the current, the voltage and the brightness (IVL) of the organic light emitting diode OLED, which is acquired based on experiments, compensation data in the case of the voltage on the light emitting element being Voled and the current second detection current Ids2 can be acquired, and the acquired compensation data is inputted into the first node N1 during a data writing period.

For example, in a case that the organic light emitting diode OLED is not aged, the organic light emitting diode OLED has a brightness of 4000 cd×m$^2$ in a case of the voltage on the organic light emitting diode OLED being 10V. While in a case that the organic light emitting diode OLED is aged, a higher voltage is required to enable the aged organic light emitting diode OLED to have the brightness of 4000 cd×m$^2$. Therefore, in this embodiment, the voltage to be compensated may be expressed as 10V-Voled.

In addition, referring to FIG. 3, the current detection method for a pixel circuit according to this embodiment further includes, after the compensation calculation period, a data writing period T9 and a display period T10.

Figure 8:
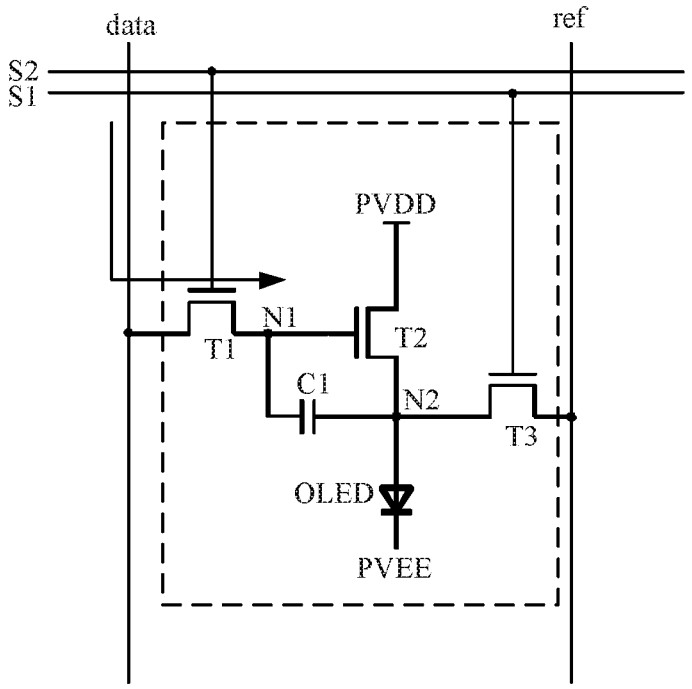
FIG. 8 is a schematic diagram illustrating a current flowing direction in the pixel circuit during another period according to the present disclosure.

During the data writing period T9, the scan signal on the scan line S1 is at a high level, and the scan signal on the scan line S2 is at a low level. At this time, the first switch transistor T1 is turned on, and the second switch transistor T3 is turned off. As shown in FIG. 8, the compensation data voltage signal Vdata2 is inputted into the first node N1 via the data line data.

Figure 9:
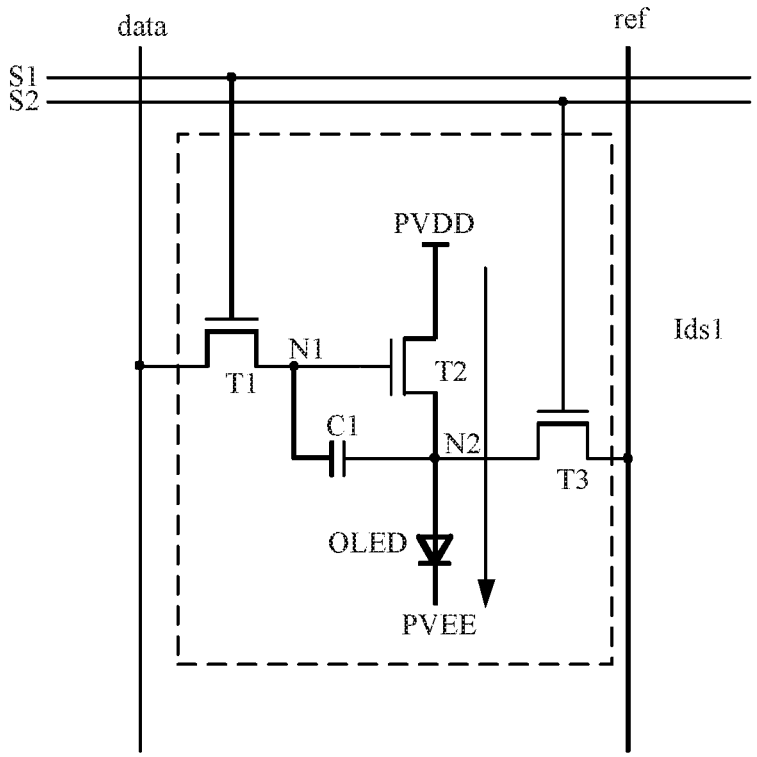
FIG. 9 is a schematic diagram illustrating a current flowing direction in the pixel circuit during another period according to the present disclosure.

During the display period T10, the scan signal on the scan line S1 and the scan signal on the scan line S2 are at a low level. At this time, as shown in FIG. 9, the first switch transistor T1 and the second switch transistor T3 are turned off, a current is inputted into the light emitting element OLED to enable the light emitting element OLED to emit light.

Based on the above embodiments, the current detection method according to this to embodiment further includes, before the first detection period T4, an initialization period T1, a pre-charge period T2 and a discharge period T3.

During the initialization period T1, the first switch transistor T1 and the second switch transistor T3 are turned on, to enable the gate of the drive transistor T2 to receive a data signal on a data line connected with the drive transistor T2, and enable the source of the drive transistor T2 to receive a reference signal on a reference line connected with the drive transistor T2.

During the pre-charge period T2, the first switch transistor is turned on, and the second switch transistor is turned off. The reference line ref is pre-charged using a pre-charge voltage.

During the discharge period T3, the first switch transistor and the second switch transistor are turned on, to enable a pixel current of the drive transistor to flow towards the reference line.

It is to be noted that, these three periods belong to a threshold detection period which is a basic operation period of the pixel circuit. During the threshold detection period, the anode of the light emitting element is reset, and data writing is performed via the data line, thereby enabling the pixel to emit light.

As can be seen, with the current detection method for a pixel circuit according to this embodiment, both a compensation for the threshold voltage Vth of the drive transistor and a compensation for the aging of the light emitting element OLED can be implemented, thus the brightness differences among pixels can be compensated.

Figure 10:
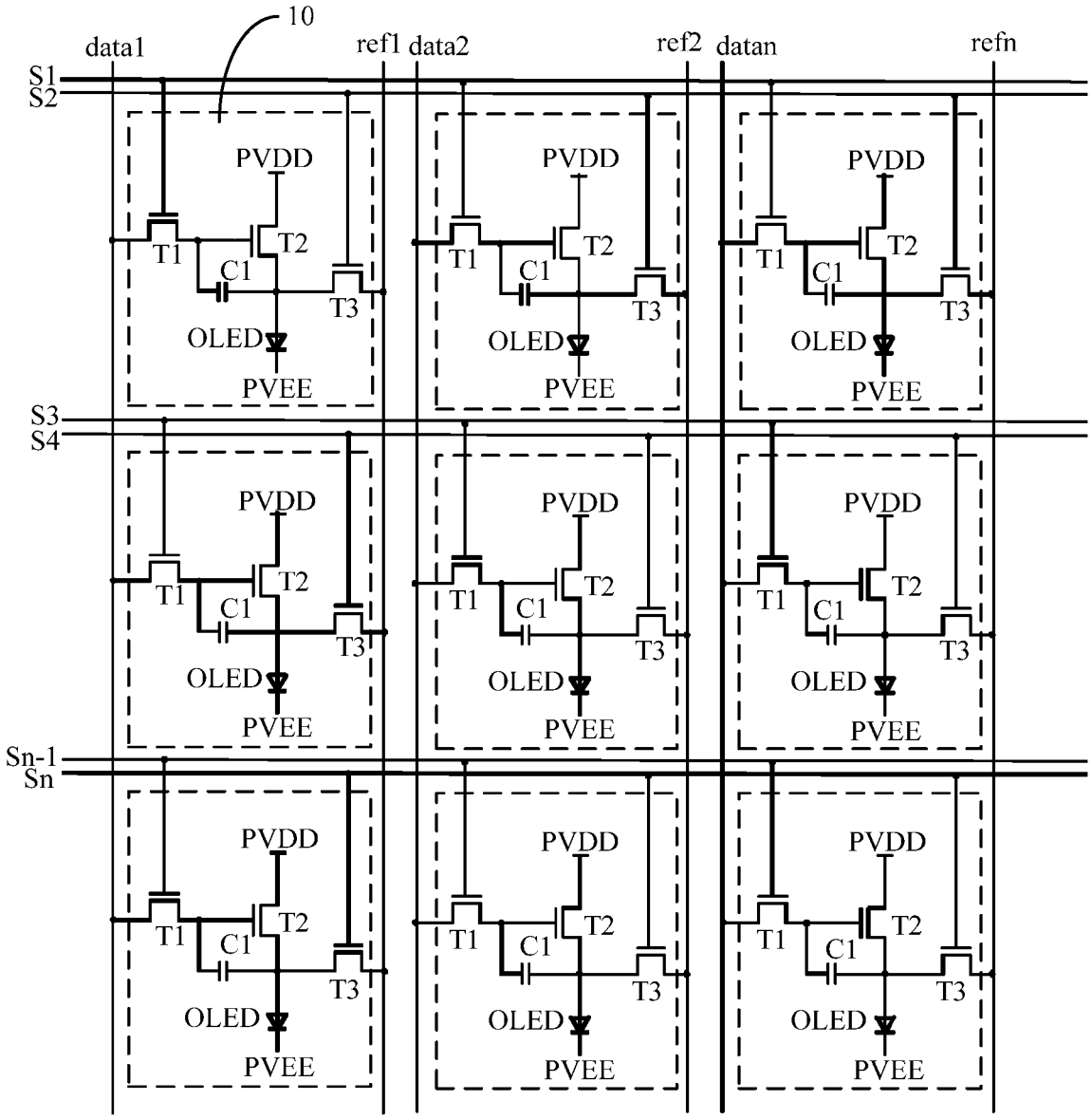
FIG. 10 is a schematic structural diagram of a display panel according to the present disclosure.

In some embodiments, as shown in FIG. 10, a display panel is further provided according to an embodiment. The display panel includes pixel units 10 arranged in an array, multiple data lines data1 to datan, multiple scan lines S1 to Sn and multiple reference lines ref1 to refn.

Each of the pixel units includes the pixel circuit according to the above embodiments. The multiple data lines are configured to provide data signals to the pixel units. The multiple scan lines are configured to provide scan signals to the pixel units. The multiple reference lines are configured to provide reference signals to the pixel units. In addition, the display panel according to this embodiment performs current detection using the current detection method according to the above embodiments.

Figure 11:
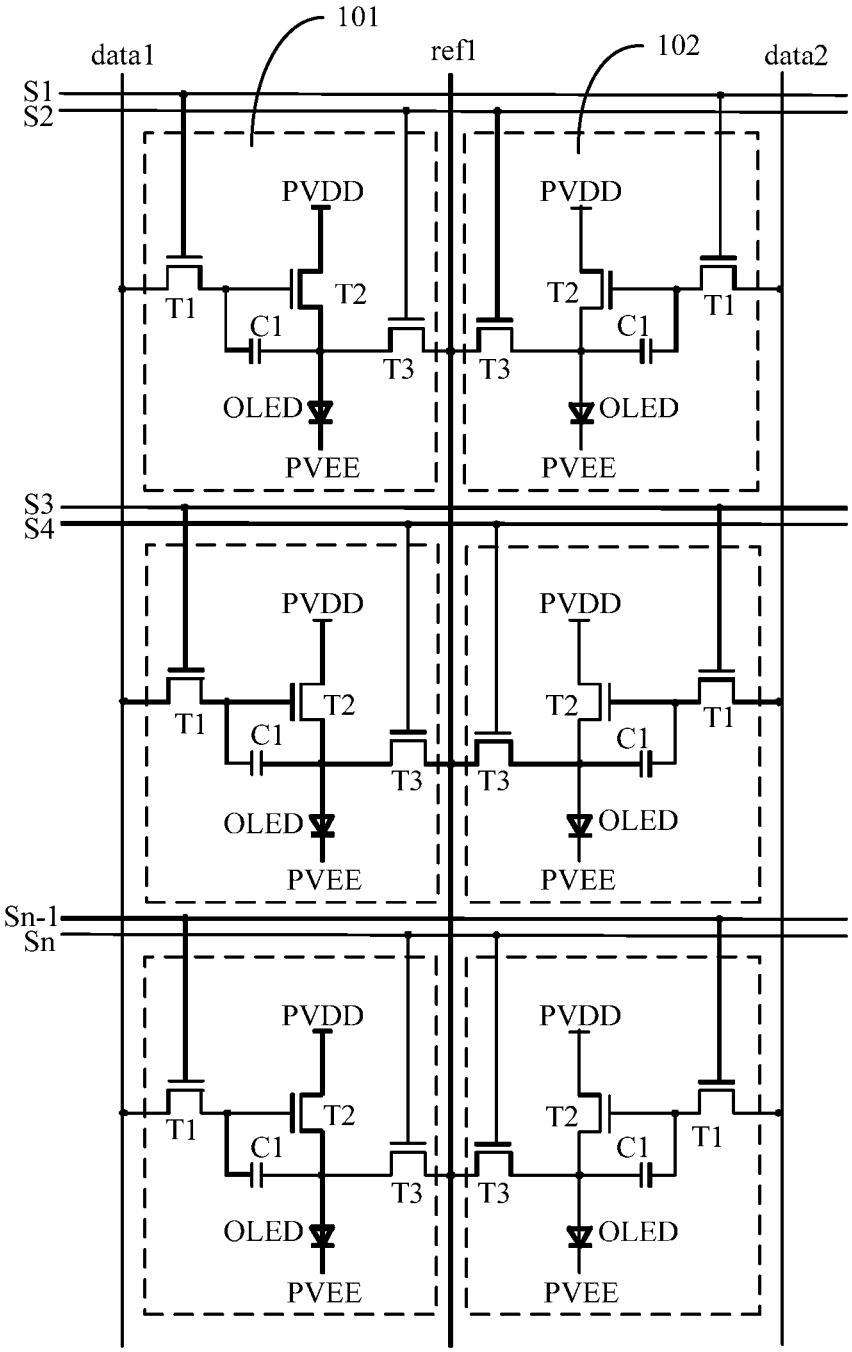
FIG. 11 is a schematic structural diagram of a display panel according to another embodiment of the present disclosure.

On the basis of the above embodiment, an arrangement of the display panel is further provided according to an embodiment. As shown in FIG. 11, two pixel units adjacent to each other in a row direction of the array share one reference line. Specifically, sources of the second switch transistors T3 in the pixel unit 101 and the pixel unit 102 are connected with the reference line ref1. With this arrangement, the number of reference lines can be reduced.

It is to be noted that, in an embodiment where the reference line is shared, when performing the current detection method for a pixel circuit according to the above embodiments, one of the pixels sharing the reference line needs to be turned off, and the current of the other of the pixels sharing the reference line is detected. For example, in FIG. 11, when the drive current of the pixel unit 101 connected with the reference line ref1 is detected, the switch transistor T1 in the pixel unit 102 needs to be turned off via the data line S1. Similarly, when the drive current of the pixel unit 102 is detected, the switch transistor T1 in the pixel unit 101 needs to be turned off via the data line S1.

In some embodiments, the two pixel units sharing one reference line ref1 are respectively arranged on two sides of the shared reference line. The shared reference line is arranged between two adjacent data lines, and the two pixel units sharing one reference line are respectively connected with the two adjacent data lines. As shown in FIG. 11, the pixel unit 101 and the pixel unit 102 are respectively arranged at two sides of the shared reference line ref1, the drain of the first switch transistor T1 in the pixel unit 101 is connected with the data line data1, and the drain of the first switch transistor T1 in the pixel unit 102 is connected with the data line data2.

Apart from this, the following arrangement can be adopted in this embodiment: first switch transistors of the two pixel units sharing one reference line are connected with a first scan line, and second switch transistors of the two pixel units sharing one reference line are connected with a second scan line. As shown in FIG. 11, the gate of the first switch transistor T1 in the pixel unit 101 and the gate of the first switch transistor T1 in the pixel unit 102 are connected with the first scan line S1, while the gate of the second switch transistor T3 in the pixel unit 101 and the gate of the second switch transistor T3 in the pixel unit 102 are connected with the second scan line S2.

Figure 12:
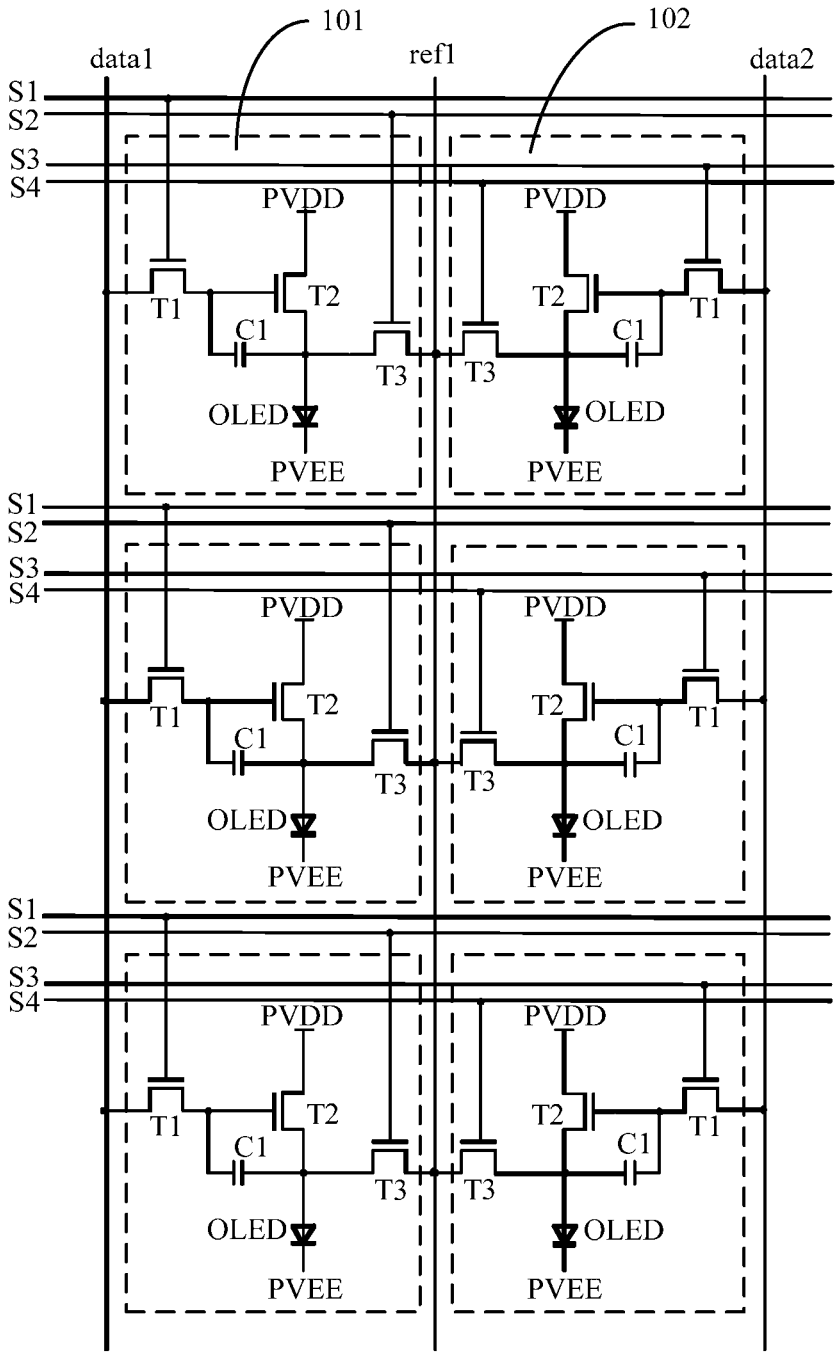
FIG. 12 is a schematic structural diagram of a display panel according to another embodiment of the present disclosure.

Of course, the above embodiment is not intended to be limiting. Whether the scan line is shared may not be limited by this embodiment. As shown in FIG. 12, the gate of the first switch transistor T1 in the pixel unit 101 is connected with the first scan line S1, and the gate of the second switch transistor T3 in the pixel unit 101 is connected with the second scan line S2. The gate of the first switch transistor T1 in the pixel unit 102 is connected with the third scan line S3, and the gate of the second switch transistor T3 in the pixel unit 102 is connected with the fourth scan line S4.

In some embodiments, the display panel according to this embodiment further includes a data driver. The data driver is configured to provide a data signal to one of the two pixel units sharing one reference line, and provide at least one of data indicating a degree of blackness and a turn-off voltage to the other of the two pixel units sharing one reference line, to enable the two pixel units sharing one reference line not to be driven simultaneously. For example, referring to FIG. 11, the data driver is configured to generate a data signal data1 and a data signal data2, where when the data signal data1 is a valid data signal, the data signal data2 is data indicating a degree of blackness or a turn-off voltage, such that when the pixel unit 101 operates, the pixel unit 102 is turned off.

It is to be noted that, in this embodiment, the drive transistor T2, the first switch transistor T1 and the second switch transistor T3 are N-type transistors. Of course, the drive transistor T2, the first switch transistor T1 and the second switch transistor T3 may also be P-type transistors. However, the N-type transistor is preferred in this embodiment since the N-type transistor has a low on-resistance and has a low cost.

A display device is further provided according to the present disclosure. The above display panel is applied to the display device.

In summary, a current detection method for a pixel circuit, a display panel and a display device to which the method is applied are provided according to the present disclosure, for implementing both a compensation for the threshold voltage Vth of the drive transistor and a compensation for the aging of the light emitting element OLED, thereby compensating brightness differences among pixels, thus the problem of non-uniform display brightness and poor image uniformity can be avoided.

In the present specification, the embodiments are described in progressive manner. Each embodiment mainly focuses on an aspect different from other embodiments, and reference can be made to these similar parts among the embodiments. With the above descriptions of the disclosed embodiments, the skilled in the art may practice or use the present disclosure. Various modifications to the embodiments are apparent for the skilled in the art. The general principle suggested herein can be implemented in other embodiments without departing from the spirit or scope of the disclosure. Therefore, the present disclosure should not be limited to the embodiments disclosed herein, but has the widest scope that is conformity with the principle and the novel features disclosed herein.

The invention claimed is:

1. A current detection method for a pixel circuit, wherein the pixel circuit comprises:

a light emitting element;

a drive transistor, configured to drive the light emitting element;

a first switch transistor, configured to provide a data signal on a data line connected with the first switch transistor to a gate of the drive transistor in response to a scan signal on a scan line;

a second switch transistor, configured to provide a reference signal on a reference line connected with the second switch transistor to a source of the drive transistor in response to a scan signal on another scan line; and a storage capacitor, configured to store a voltage between the gate and the source of the drive transistor, a charged voltage of the storage capacitor being used as a drive voltage for the drive transistor; and the current detection method comprises:

during an initialization period, turning on the first switch transistor and the second switch transistor, wherein the gate of the drive transistor receives a data signal on a data line connected with the drive transistor, and the source of the drive transistor receives a reference signal on a reference line connected with the drive transistor;

during a pre-charge period, turning on the first switch transistor and turning off the second switch transistor, to pre-charge the reference line using a pre-charge voltage;

during a discharge period, turning on the first switch transistor and the second switch transistor, wherein a pixel current of the drive transistor flows towards the reference line;

during a first detection period, turning on the first switch transistor and the second switch transistor, to input a first data voltage signal via the data line and input a first reference voltage signal via the reference line;

during a second detection period, turning off the first switch transistor and turning on the second switch transistor, to acquire a first detection current on the reference line when a voltage on the reference line reaches a saturation voltage and acquire a value of the saturation voltage on the reference line, wherein no voltage signal is inputted to the source of the drive transistor from the reference line, and after the value of the saturation voltage on the reference line is acquired, a threshold voltage of the drive transistor is calculated, and the threshold voltage of the drive transistor is compensated to have a preset value by a data driver connected to the reference line;

during a third detection period, turning on the first switch transistor and turning off the second switch transistor, to input a second data voltage signal via the data line; and during a fourth detection period, turning off the first switch transistor and turning on the second switch transistor, to acquire a second detection current on the reference line, wherein a value of the second data voltage signal is acquired in a case that the second detection current is equal to the first detection current; and during a compensation calculation period, turning off the first switch transistor and the second switch transistor, and calculating, by a control unit, a compensation data voltage signal based on the first detection current and the second detection current, wherein after the value of the second data voltage signal is acquired, a voltage on the light emitting element is calculated based on the second data voltage signal, the first data voltage signal and the first reference voltage signal, and the compensation data voltage signal is determined based on the second detection current and the calculated voltage on the light emitting element according to a functional relationship between current, voltage and brightness (IVL) of the light emitting element, and wherein the IVL functional relationship of the light emitting element is acquired based on experiments; and during a data writing period, turning on the first switch transistor and turning off the second switch transistor, to input, via the data line, the compensation data voltage signal that is determined according to the IVL functional relationship of the light emitting element, wherein the first detection period, the second detection period, the third detection period and the fourth detection period are consecutive detection periods, the first detection period, the second detection period, the third detection period and the fourth detection period are performed successively, and no time interval is set between any adjacent detection periods of the first detection period, the second detection period, the third detection period and the fourth detection period.

2. The current detection method according to claim 1, wherein the calculating, by the control unit, the compensation data voltage signal based on the first detection current and the second detection current comprises:

calculating a voltage of the compensation data voltage signal when the second detection current is equal to the first detection current.

3. The current detection method according to claim 1, wherein after the data writing period, the method further comprises:

during a display period, turning off the first switch transistor and the second switch transistor.

4. A display panel, comprising:

pixel units arranged in an array, wherein each of the pixel units comprises the pixel circuit according to claim 1;

a plurality of data lines, configured to provide data signals to the pixel units;

a plurality of scan lines, configured to provide scan signals to the pixel units; and a plurality of reference lines, configured to provide reference signals to the pixel units, wherein the current detection method for a pixel circuit according to claim 1 is applied to the display panel.

5. The display panel according to claim 4, wherein two pixel units adjacent to each other in a row direction of an array share one reference line.

6. The display panel according to claim 5, wherein the two pixel units sharing one reference line are respectively arranged on two sides of the shared reference line, the shared reference line being arranged between two adjacent data lines, and the two pixel units sharing one reference line being respectively connected with the two adjacent data lines.

7. The display panel according to claim 6, wherein first switch transistors of the two pixel units sharing one reference line are connected with a first scan line, and second switch transistors of the two pixel units sharing one reference line are connected with a second scan line.

8. The display panel according to claim 7, further comprising a data driver configured to provide a data signal to one of the two pixel units sharing one reference line, and provide at least one of data indicating a degree of blackness and a turn-off voltage to the other of the two pixel units sharing one reference line, wherein the two pixel units sharing one reference line are not driven simultaneously.

9. The display panel according to claim 4, wherein the drive transistor is an N-type transistor.

10. The display panel according to claim 4, wherein both the first switch transistor and the second switch transistor are N-type transistors.

11. The display panel according to claim 4, wherein the light emitting element is an organic light emitting diode.

12. A display device, comprising the display panel according to claim 4.

13. The display device according to claim 12, wherein two pixel units adjacent to each other in a row direction of the array share one reference line.

14. The display device according to claim 13, wherein the two pixel units sharing one reference line are respectively arranged on two sides of the shared reference line, the shared reference line being arranged between two adjacent data lines, and the two pixel units sharing one reference line being respectively connected with the two adjacent data lines.

15. The display device according to claim 14, wherein first switch transistors of the two pixel units sharing one reference line are connected with a first scan line, and second switch transistors of the two pixel units sharing one reference line are connected with a second scan line.

16. The display device according to claim 15, wherein the display panel further comprises a data driver configured to provide a data signal to one of the two pixel units sharing one reference line, and provide at least one of data indicating a degree of blackness and a turn-off voltage to the other of the two pixel units sharing one reference line, wherein the two pixel units sharing one reference line are not driven simultaneously.

17. The display device according to claim 12, wherein the drive transistor is an N-type transistor.

18. The display device according to claim 12, wherein both the first switch transistor and the second switch transistor are N-type transistors.

* * * * *